US007419334B2

(12) United States Patent
Baugh

(10) Patent No.: US 7,419,334 B2
(45) Date of Patent: Sep. 2, 2008

(54) THRUSTER FLOOD CONTROL METHOD

(76) Inventor: Benton Frederick Baugh, 14626 Oak Beng, Houston, TX (US) 77079

( * ) Notice: Subject to any disclaimer, the term of this patent is extended or adjusted under 35 U.S.C. 154(b) by 1797 days.

(21) Appl. No.: 09/934,345

(22) Filed: Aug. 22, 2001

(65) Prior Publication Data

US 2007/0274782 A1 Nov. 29, 2007

(51) Int. Cl.
*E02B 3/00* (2006.01)

(52) U.S. Cl. ..... 405/80; 405/39

(58) Field of Classification Search ..... 405/36, 405/80, 81, 84, 303, 39
See application file for complete search history.

(56) References Cited

U.S. PATENT DOCUMENTS 2,612,861 A * 10/1952 Burkey ..... 119/219
2,751,881 A * 6/1956 Burkey ..... 119/219
2,761,421 A * 9/1956 Burkey ..... 119/219
5,632,572 A * 5/1997 Chicha ..... 405/80
5,673,449 A * 10/1997 Henriksson et al. ..... 405/80
6,729,800 B2 * 5/2004 Burns, II ..... 405/81
6,736,572 B2 * 5/2004 Geraghty ..... 405/80

* cited by examiner

*Primary Examiner*—Frederick L Lagman

(57) ABSTRACT

A means of alleviating or preventing flooding in geographic areas which are normally drained by slow moving water in ditches, rivers, bayous or other waterways of relatively shallow slope by using a water thrusting means to add kinetic energy and therefore velocity to a portion of the water, mixing the portion back in the main body of water in a downstream direction to increase the average velocity downstream of the main body of water, and thereby move water away from the flooding area to a remote area more quickly than would occur naturally.

2 Claims, 6 Drawing Sheets

THRUSTER FLOOD CONTROL METHOD

BACKGROUND OF THE INVENTION

Conventional flood control is done by having a waterway such as bayous, rivers, or streams lead from the area in which it is raining toward the ocean, or in the case of the Houston area, to the Gulf of Mexico. As rain falls, water travels down to the lower parts of the waterway at a speed which is a function of the grade or slope of the waterway and the depth of the water. The more the grade or the difference in height from where the rain is falling to the ocean, the faster the water will flow and when water is deeper, more of the water is away from the wall effects and therefore it will flow faster as more and more rain falls. The waterway will become increasingly fuller until at some point the amount of water which will flow down to the waterway is exceeded by the amount of rain fall, and therefore you have a flood.

The elevation of the seawater the water is flowing to and the elevation of the area in which the rain is falling on are not variable for a specific location. Therefore the conventional methods for increasing the amount of flow is by making the waterway larger, making it straighter so that the water will not be slowed down by making turns, and removing friction causing impediments from the waterway such as trees.

In the case of the Great Flood of 2001 in the City of Houston, the elevation between the flooded area and the Gulf of Mexico was about 24 feet above sea level and the distance from the flooded area to the Gulf Mexico was about 20 miles. So the driving force of the rainwater was a head of about 24 feet. It literally would not do a substantial amount of good to make the waterway significantly deeper because if the waterway were significantly deeper it would potentially be below sea level. To make the waterway progressively wider to increase the volume in a highly urbanized area is a massive investment in the purchase of land and the movement of earth, and the changes to other civil engineering structures such as bridges and roads.

This invention will be primarily discussed in terms of the sites specific application of Houston, Tex. and the flood of 2001. However, it can be applied to a number of other localities such as even flooding on the Mississippi River can be prevented by the methods discussed herein.

Flooding is caused because water is concentrated in an area and is not caused to move out of that area to the sea. That is an obvious statement, but it is a statement well worth considering. If we take one pound of water in the middle of the flood in Houston and desire to deliver it to the Gulf of Mexico at sea level, it will be reduced in height by the amount of the elevation in Houston to the elevation of sea level or about 24 feet. In other words it will give up about 24 foot-pounds of energy in the transportation from Houston to the Gulf of Mexico. Where do the 24-foot pounds go? The 24 foot-pounds of energy goes to frictional losses moving down Buffalo Bayou from Houston to the Gulf of Mexico. A certain amount of the energy is retained in kinetic energy as it has a velocity as it enters the Gulf of Mexico and so some part of the energy is given up due to frictional losses traveling down Buffalo Bayou some of it is kinetic energy which dissipates into the Gulf of Mexico as it arrives at the Gulf of Mexico. Pound for pound this says that each pound of water in the middle of the flood has 24 pound-feet of energy available to drive itself from the flooded area to the Gulf of Mexico. This additionally says that in the flooded situation in the City of Houston with the volume of water to be handled at that time, 24 foot-pounds of energy is not enough to drive the water away fast enough to prevent flooding. We literately have an objective measure that says this is not enough energy, not enough horsepower or however you want to say it, to get the job done.

SUMMARY OF THE INVENTION

The object of this invention is to provide a means to minimize and or completely eliminate flooding from occurring in an area such as Houston, even in a 500 year rain scenario such as happened in 2001.

A second objective is to provide means to eliminate flooding at a economic cost. In this particular case in Houston, $4.8 billions of cost were incurred in the City of Houston. But the one number that is of particular interest is at the University of Houston. It is estimated that two hundred and fifty million dollars worth of flood damage was done in this one site alone. It is a suggestion of this application that an investment of the same two hundred and fifty million dollars in the greater Houston area would eliminate all significant flooding permanently.

Another object of this invention is not to do great civil engineering projects that digs great ditches to carry the flow away but rather provide enough energy or enough horsepower to move the water fast enough so that the flooding does not occur.

BRIEF DESCRIPTION OF THE DRAWINGS

FIG. 2 is a view of the same general area in which the bayous are full and flooding has occurred both in the downtown area and in the University of Houston area. The thruster packages of this invention are shown in place, but not turned on.

FIG. 3 is a view of the same general area with the flooding remedied by turning the thrusters on.

DESCRIPTION OF THE PREFERRED EMBODIMENT

Figure 1:
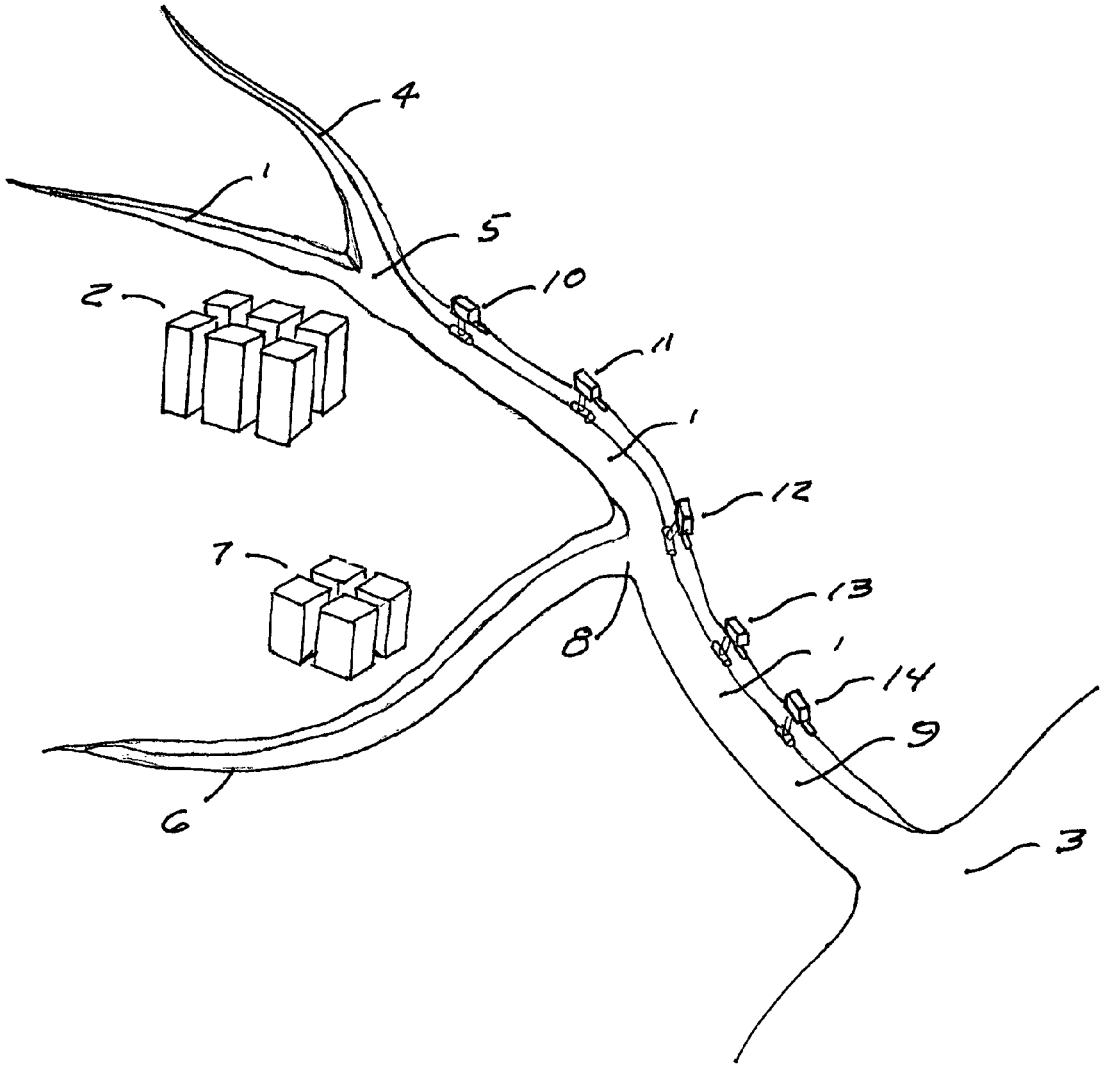
FIG. 1 is a view of the general geographic area of Houston showing water flowing normally past downtown in Buffalo Bayou and by the University of Houston flowing in Brays Bayou, and finally in the bay system into the Gulf of Mexico. The thruster packages of this invention are shown in place on Buffalo Bayou only.

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

How do we input power into water in open channels? Remote sub sea vehicles, thrusters on great vessels and even propellers on large ships are means to put energy into water, to cause water to move in one direction, normally with the objective of moving the vessel in the opposite direction. Literally a propeller takes a small poundage of water and throws it to the rear of the ship. That energy of throwing the water to the rear of the ship causes an equal reaction in the opposite direction and provides force to move the ship forward. One can see the water speeding from the propeller at rear of a boat. Imagine that a giant propeller the size of a river is turning in a river, you can easily see that the water in the river will be accelerated.

Now imagine that every one thousand feet along the Houston Ship Channel from downtown Houston to the start of the bay system into the Gulf of Mexico we put a water jet thruster package into the water. It is a distance of about 20 miles. That would be about 5 thruster packages per mile or about 100 thruster packages. Now assume in the normal flood situation, the waters are being carried away from downtown Houston, down the Houston Ship Channel, at approximately 3 miles per hour. The speed is a balance between the energy provided by the water and the frictional forces resisting it.

Now assume that we have enough thrusters and we put enough power in each of the thrusters to increase the speed of the water to 6 miles per hour. If we literally increase the speed of the water in the Houston Ship Channel from 3 miles per hour to 6 miles per hour, we increase the flow rate from about 150 million cubic feet per hour to about 300 million cubic feet per hour and the flood disappears.

The better scenario isn't that we turn on the thrusters and cause the flood to go away, but when the rain comes we turn on the thrusters and the flood never happens in the first place.

If the estimate of water at flood stage in Buffalo Bayou from Houston is a minimum of 36 feet deep, 300 feet wide at the surface, 228 feet wide at the bottom and the water flowing at the rate of 3 miles per hour, that would mean that a total of 1,003,622 cubic feet of water would be flowing, or 62,626,037,760 lbs. of water would be flowing. If the bayou slopes 24' in 20 miles, it drops 1.2 feet per mile or 3.6 feet in one hour, or 0.000682 feet per minute. The energy derived is 0.000682 feet times 62,626,037,760 lbs. or 42,699,571 feet-pounds per minute. This divided by 33,000 gives 1,294 horsepower.

If the power required is a function of the square of the velocity, and the system method is only 50% efficient, then 1294*4/0.5=10352 horsepower. If we divide the 10352 horsepower by the 100 thruster stations, we get that each of the thruster stations would require a minimum of 103.5 horsepower.

Referring now to FIG. 1, Buffalo Bayou 1 flows from west of Downtown Houston 2 thru a bay system into the Gulf of Mexico 3. White Oak Bayou 4 flows into Buffalo Bayou 1 at the confluence 5. Brays Bayou 6 flows by the University of Houston 7 and intersects Buffalo Bayou at 8.

A multiplicity of thrusters 10-14 are shown in Buffalo Bayou 1, the lower end of Buffalo Bayou actually being the Houston Ship Channel 9. The thrusters 10-14 are shown above the water level in normal conditions in FIG. 1.

Figure 2:
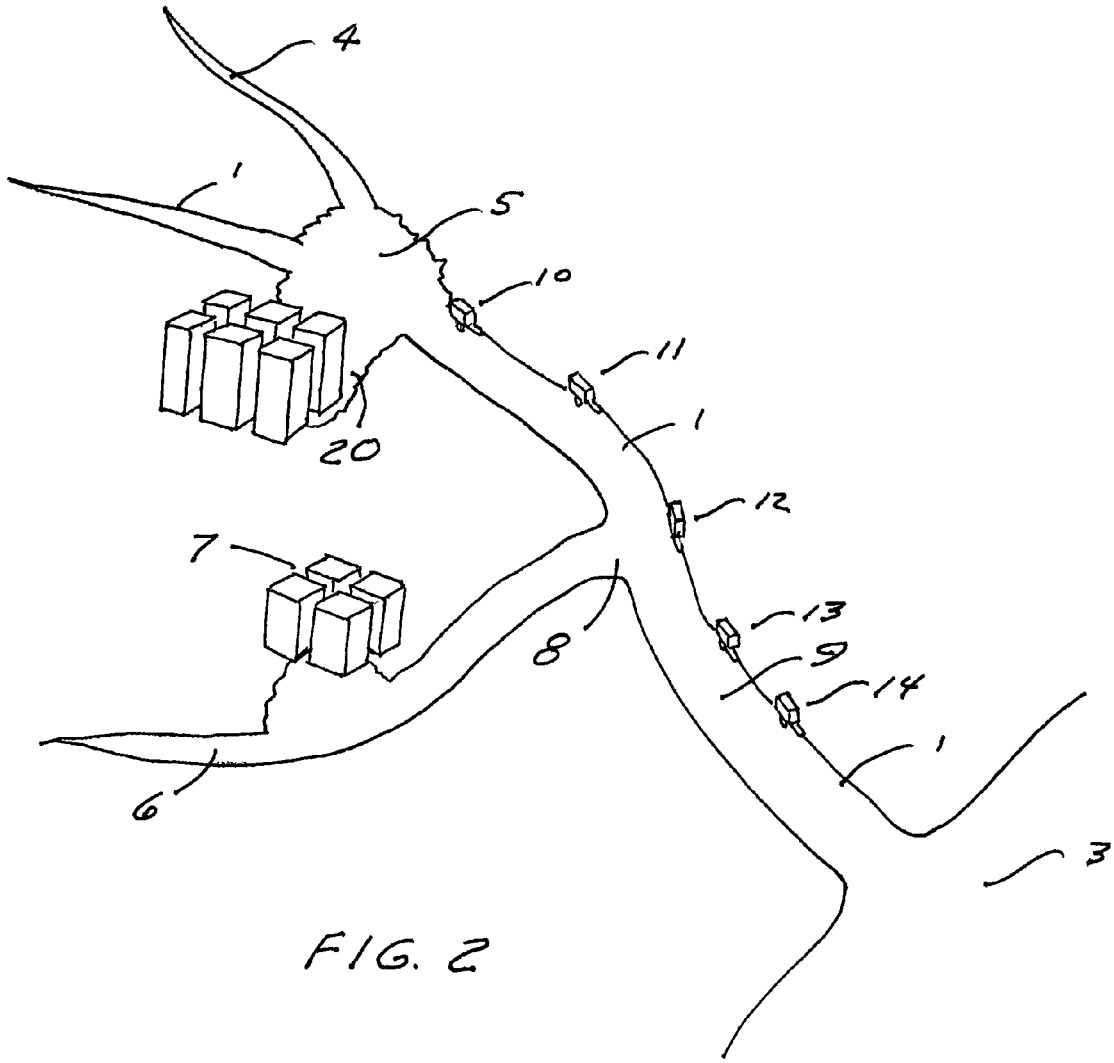

Referring now to FIG. 2, generally in the area of the confluence 5 of Buffalo Bayou 1 and White Oak Bayou, a major storm happened in the summer of 2001, causing more water to fall than Buffalo Bayou 1 could carry off to the Gulf of Mexico. As a direct result, a major flooding occurred generally in the area of the confluence of Buffalo Bayou and White Oak Bayou 5. Flooding 20 proceeded into downtown Houston 2 causing massive damage. Additionally, as Buffalo Bayou 1 was carrying as much water as it could carry, any rain falling onto the area of Brays Bayou 6 near the University of Houston had no means of flowing away, but simply collected. This resulted in major flooding in the area of the University of Houston, resulting in approximately $250 million dollars in damages.

Figure 3:
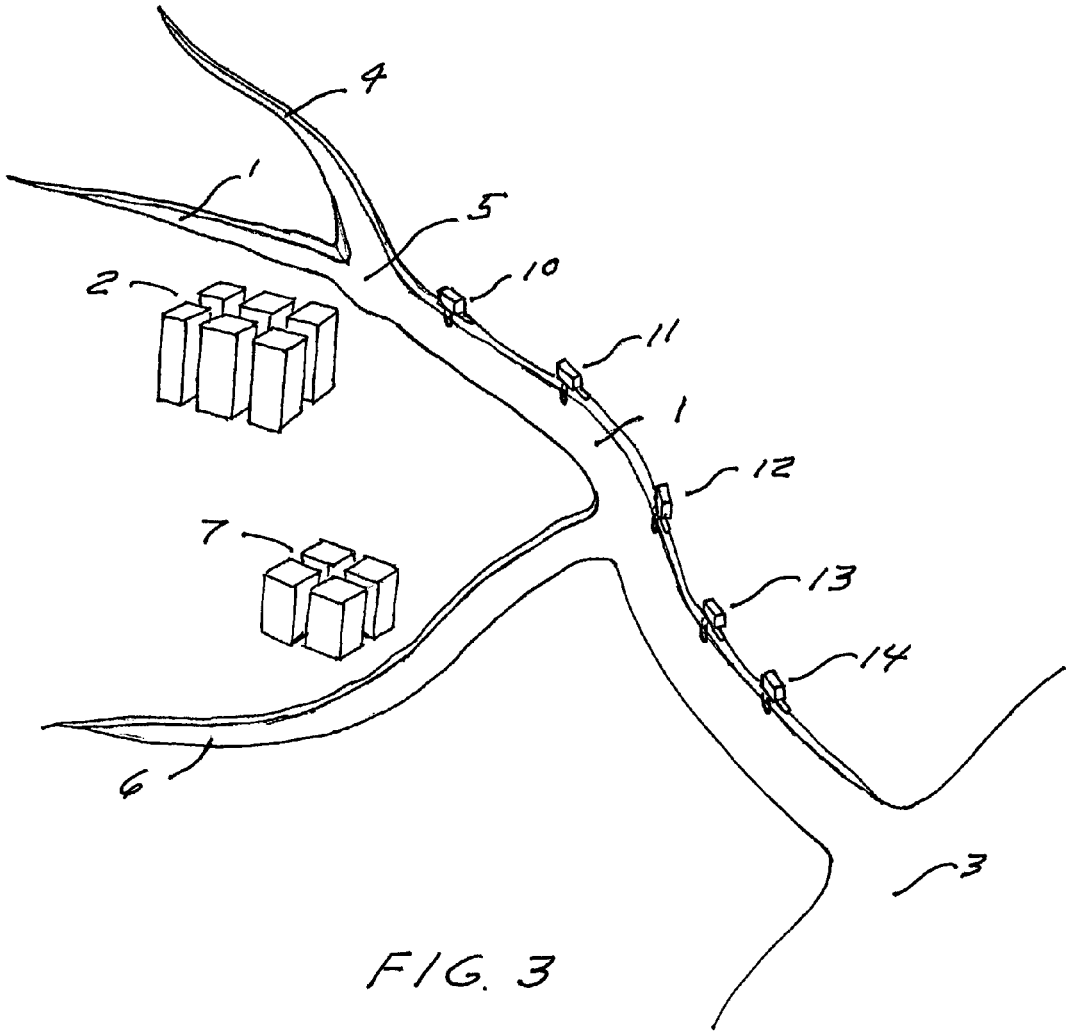

Referring now to FIG. 3, the thrusters of this invention have been turned on, causing the waters in Buffalo Bayou to flow faster. This results first in the flooding 20 in downtown Houston 2 being alleviated. Secondly, as the waters in Brays Bayou 6 now have someplace to flow, the flooding at the University of Houston 7 is eliminated. Although not shown on the figures, flooding also occurred along White Oak Bayou 4 which would not have happened if the methods of this invention had been applied.

Figure 4:
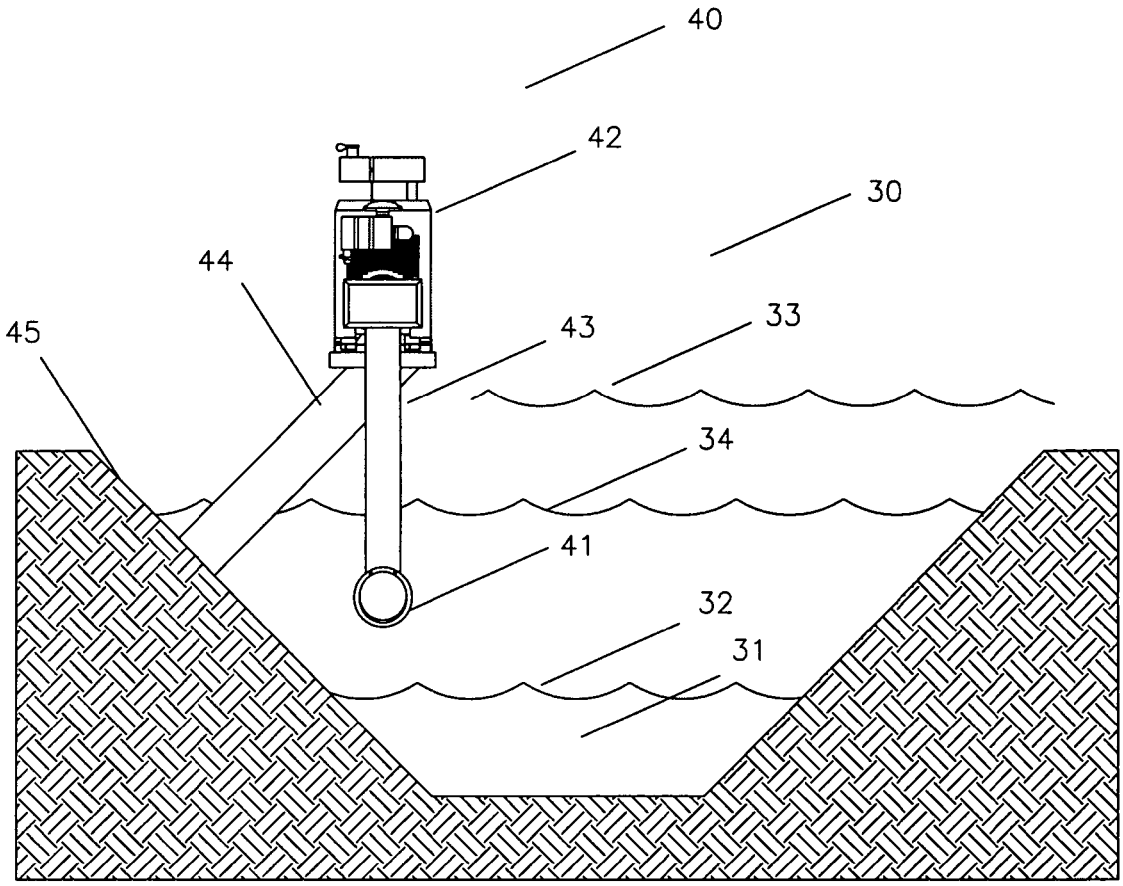
FIG. 4 is a cross section of a waterway or other drainage channel with a thruster of the invention in place.

Referring now to FIG. 4, a bayou or river 30 is shown with water 31 flowing at a normal level 32. Additionally, flood level waters are shown at 33, and an intermediate level of water is shown at 34. A thruster system is shown at 40 with the thruster 41 at a level above the normal flow of water at 32, but in the water below levels 33 and 34. An engine is shown at 42, with a shaft 43 going down to the thruster 41. Support column 44 is shown from beneath the engine 42 going into the bank 45 of the bayou or river 30.

The thruster 41 is effectively shown being mounted parallel to the center of the water way and on one side only. In actual practice, benefits will be seen from having thrusters on opposite sides of the waterway and inclined rotated slightly toward the center of the waterway to optimize the addition of kinetic energy to the water in preference to added bank friction.

Figure 5:
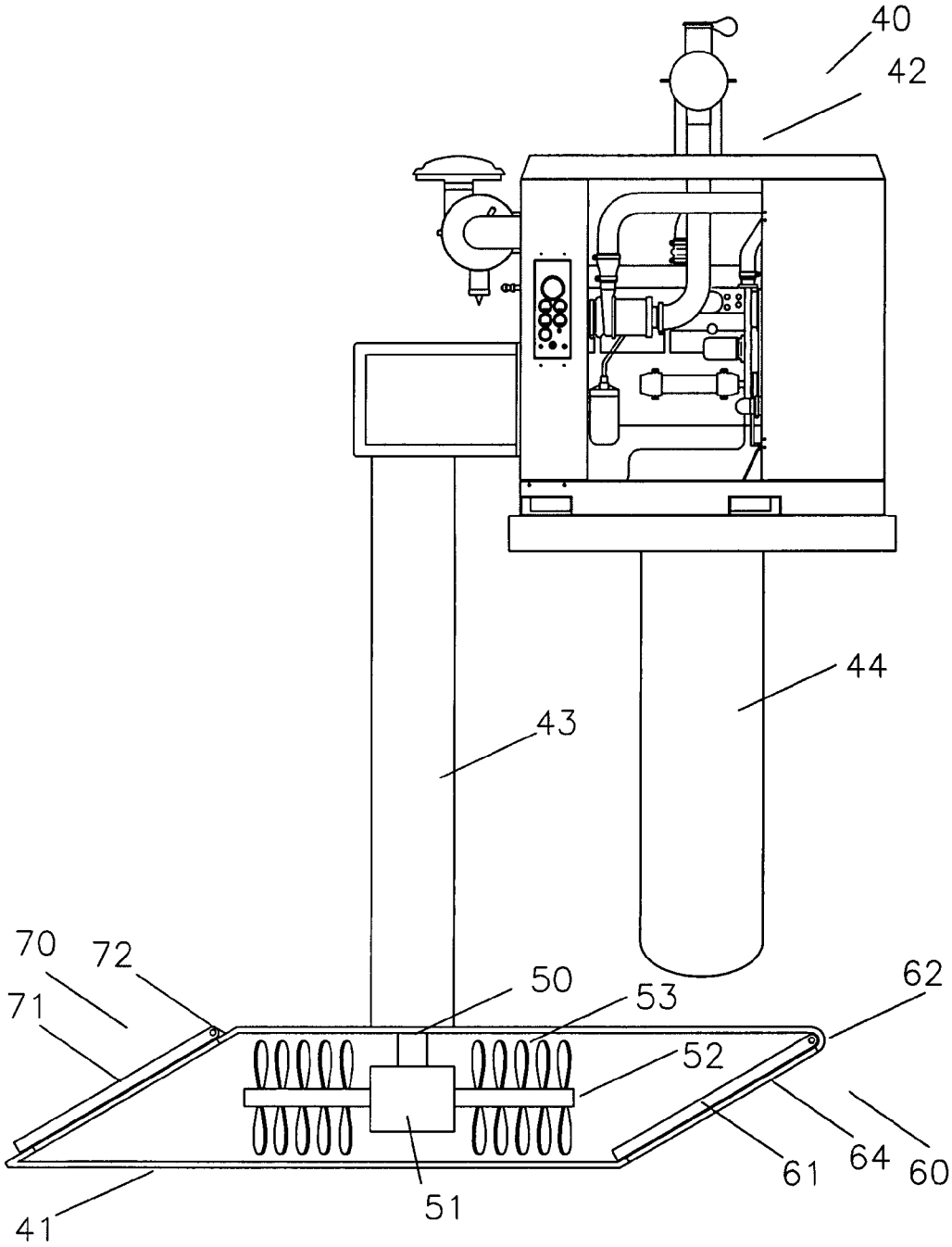
FIG. 5 shows a partial section thru a thruster not in operation and with the protective covers closed.

Referring now to FIG. 5, the thruster 41 has a power shaft 50 coming down from the engine 42 into a right angle gear box 51. Shaft 52 from the gear box 51 drives a series of propellers 53 to thrust the water. On the front end 60 of the thruster is a door 61 which is hinged at 62 to allow itself to be opened by the movement of water, but will normally be closed. In front of door 61 is bar grating 64 mounted at a sloping angle to prevent large trash from hitting the propellers 53. At the rear 70 of the thruster 41 is another door 71 which opens up due to the flow of water with a hinge at 72, but is normally closed.

Figure 6:
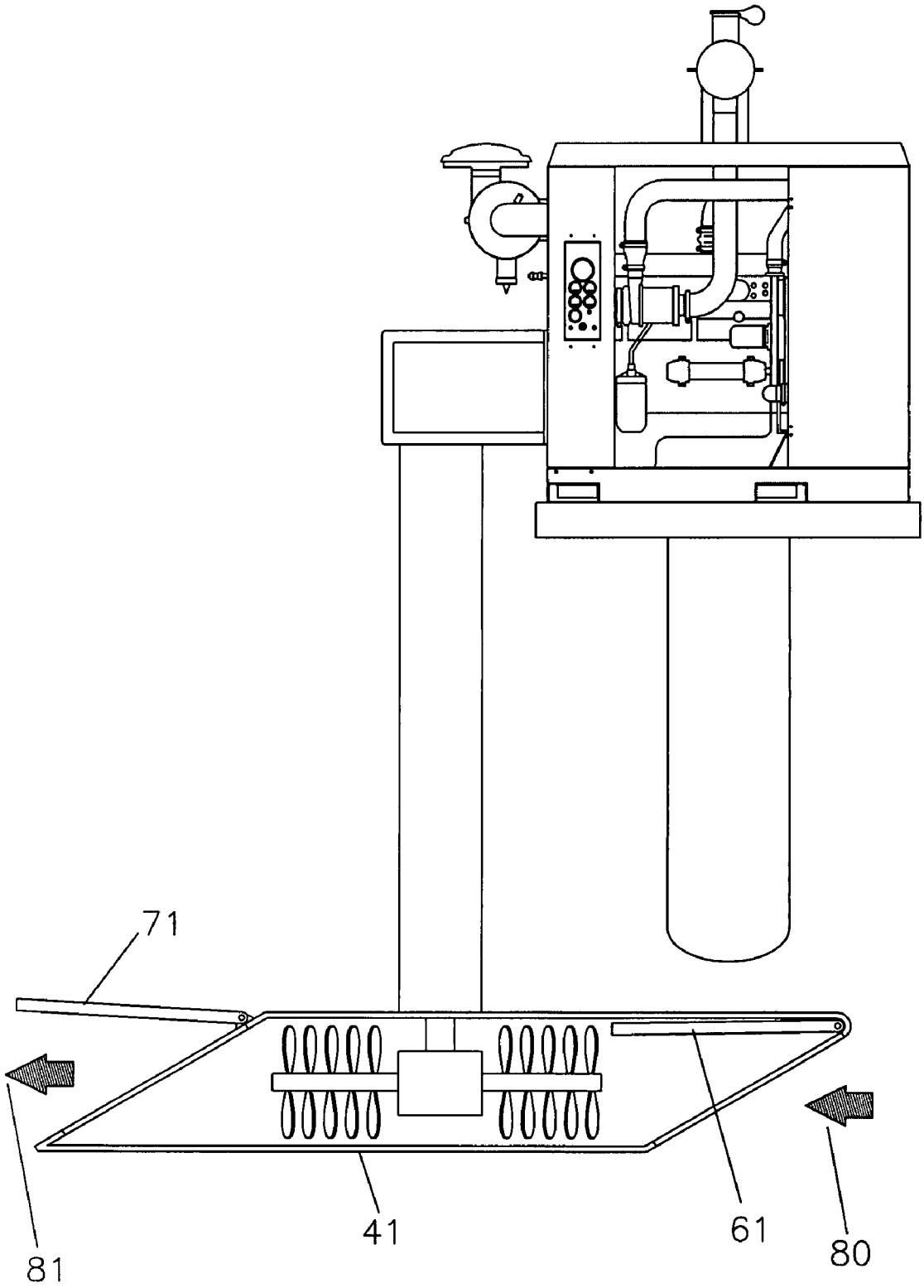
FIG. 6 shows a view similar to FIG. 5, but with the thruster turned on, with water flowing thru the thruster, and the protective covers opened.

Referring now to FIG. 6, inlet water is shown at 80 and faster moving thrusted water 81 is shown exiting the thruster 41. Doors 61 and 71 are shown opened by the movement of the water.

The particular thruster means shown in the figures is a series of propellers mounted in a cylindrical housing. Any number of embodiments for a thruster can be utilized in this service, such as a single open propeller, gear pumps, or piston pumps.

As the water level rises in the waterway, various means such as floats can be utilized to automatically turn the engine on to drive the thruster until the water level drops satisfactorily. Additionally, remote or radio controlled means can be easily utilized to start, stop, or regulate the speed of the thrusters.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A method for the prevention or remediation of flooding waters in a geographic area comprising using one or more thrusters to increase the velocity of a portion of the water in a channel draining said flooding waters away from said geographic area, mixing said portion of said waters back in to the remainder of said waters in said channel increasing the average velocity of said waters in said drainage system, and thereby increasing the rate of removal of said flooding waters from said geographic area, wherein protective doors automatically close when said one or more thrusters are not in operation and automatically open when said one or more thrusters are in operation.

2. A method for the removal of waters flooding or tending to flood a geographic area comprising using one or more thrusters to increase the velocity of a portion of said waters in a channel draining said waters away from said geographic area, mixing said portion of said waters back in to the remainder of said waters in said channel increasing the average velocity of said waters in said channel, thereby increasing the rate of removal of said waters from said geographic area, wherein protective doors automatically close when said one or more thrusters are not in operation and automatically open when said one or more thrusters are in operation.

* * * * *